US007125265B2

(12) United States Patent
Weng

(10) Patent No.: US 7,125,265 B2
(45) Date of Patent: Oct. 24, 2006

(54) ELECTRONIC DEVICE WITH VARIOUS SIGNAL TRANSMISSION CONNECTORS

(75) Inventor: Shih-Lung Weng, Kaohsiung (TW)

(73) Assignee: BENQ Corporation, Taouyuan (TW)

( * ) Notice: Subject to any disclaimer, the term of this patent is extended or adjusted under 35 U.S.C. 154(b) by 0 days.

(21) Appl. No.: 11/113,282

(22) Filed: Apr. 25, 2005

(65) Prior Publication Data

US 2006/0211283 A1 Sep. 21, 2006

(30) Foreign Application Priority Data

Mar. 16, 2005 (TW) ..... 94108013 A

(51) Int. Cl.
*H01R 13/44* (2006.01)

(52) U.S. Cl. ..... 439/131; 439/528; 439/172; 439/52; 361/737; 361/752

(58) Field of Classification Search ..... 439/131, 439/136, 528, 172, 52, 173, 174; 361/737, 361/752

See application file for complete search history.

(56) References Cited

U.S. PATENT DOCUMENTS 4,626,052 A * 12/1986 Rumble ..... 439/173
5,613,863 A * 3/1997 Klaus et al. ..... 439/131
6,261,109 B1 * 7/2001 Liu et al. ..... 439/131
6,456,500 B1 9/2002 Chen
6,464,519 B1 * 10/2002 Hawks ..... 439/172
6,544,051 B1 * 4/2003 Su ..... 439/131
6,612,853 B1 9/2003 Wu
6,733,329 B1 5/2004 Yang
6,793,509 B1 * 9/2004 Chen ..... 439/136
6,808,400 B1 10/2004 Tu
6,908,038 B1 * 6/2005 Le ..... 235/492
6,923,666 B1 * 8/2005 Liao ..... 439/172
2006/0073717 A1 * 4/2006 Ng et al. ..... 439/131

* cited by examiner

*Primary Examiner*—Tho D. Ta
(74) *Attorney, Agent, or Firm*—Birch, Stewart, Kolasch & Birch, LLP

(57) ABSTRACT

An electronic device with various signal transmission connectors. The electronic device comprises a main body, a first signal transmission module slidably disposed in the main body and a second signal transmission module slidably disposed in the main body. The first signal transmission module comprises a first connector projecting from or received in the main body and the second signal transmission module comprises a second connector projecting from or received in the main body. The first connector and the second connector cannot project from the main body simultaneously.

15 Claims, 8 Drawing Sheets

ELECTRONIC DEVICE WITH VARIOUS SIGNAL TRANSMISSION CONNECTORS

BACKGROUND

The invention relates to an electronic device with various signal transmission connectors, and in particular to an electronic device with various signal transmission connectors which cannot be used simultaneously.

Typically, MP3 players or flash memory device can only be accessed passively. This means an MP3 player or a flash memory device must be connected to a laptop or desktop computer, which controls data transaction therebetween, meaning data transmission between two MP3 players cannot be accomplished independently.

With the development of MP3 players, certain chips therein have been provided to transmit data between two MP3 players. The MP3 players with the described functions are referred to as MP3A players. When a MP3A player is connected to a computer, the computer acts as a host device and the MP3A player acts as a slave device, wherein data transmission is controlled by the computer. When the MP3A player is connected to an ordinary MP3 player, the MP3A player acts as a host device and the MP3 player acts as a slave device, wherein data transmission is controlled by the MP3A player. According to the described requirements, the MP3A player must be capable of connecting to both a computer and a MP3 player.

The universal serial bus (USB) is commonly used in MP3 players for data transmission. The USB interface has two terminal types, the USB type A which is often used in laptops or desktops and the USB type B which is often used in handheld devices such as digital cameras or MP3 players. As it is possible to use both USB types, a cable comprising two sub-cables, one for USB type A and the other for USB type B, is often provided for connection to a computer or MP3 player. It is, however, inconvenient to carry the cable with the MP3A player.

SUMMARY

An electronic device according to an embodiment of the invention comprises a main body, a first signal transmission module slidably disposed in the main body and a second signal transmission module slidably disposed in the main body. The first signal transmission module comprises a first connector projecting from or received in the main body and the second signal transmission module comprises a second connector projecting from or received in the main body. The first connector and the second connector cannot simultaneously project from the main body.

The first signal transmission module further comprises a first stopper engaging and fixing the second signal transmission module when the first signal transmission module slides to project the first connector from the main body. The second signal transmission module further comprises a second stopper engaging and fixing the first signal transmission module when the second signal transmission module slides to project from the second connector from the main body.

The first signal transmission module further comprises a first module body, a first extending portion and a first spring arm. The first module body is connected to the first connector and slidably disposed in the main body. The first extending portion extends from the first module body. The first spring arm extends from the first module body parallel to the first extending portion to form a first gap into which the second stopper is inserted to fix the first signal transmission module when the second connector projects from the main body.

The first stopper is preferably disposed on the first extending portion.

The first signal transmission module further comprises a first positioning element and a first push portion. The first positioning element is disposed on the first spring arm and secures the first module body to the main body when engaging with the main body. The first push portion is disposed on the first spring arm. The first positioning element is released from the main body when the first push portion is pushed, enabling the first module body to slide.

The main body comprises a first hole and a second hole. The first connector projects from the main body when the first positioning element engages the first hole, and the first connector is received in the main body when the first positioning element engages the second hole.

The second signal transmission module further comprises a second module body, a second extending portion, and a second spring arm. The second module body is connected to the second connector and slidably disposed in the main body. The second extending portion extends from the second module body. The second spring arm extends from the second module body parallel to the second extending portion to form a second gap into which the first stopper is inserted to fix the second signal transmission module when the first connector projects from the main body.

The second stopper is preferably disposed on the second extending portion.

The second signal transmission module further comprises a second positioning element and a second push portion. The second positioning element is disposed on the second spring arm and secures the second module body to the main body when engaging with the main body. The second push portion is disposed on the second spring arm. The second positioning element is released from the main body when the second push portion is pushed, whereby the second module body is slidable.

The main body further comprises a third hole and a fourth hole. The second connector projects from the main body when the second positioning element engages the third hole, and the second connector is received in the main body when the second positioning element engages the fourth hole.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the subsequent detailed description and the accompanying drawings, which are given by way of illustration only, and thus are not limitative of the present invention, and wherein.

DETAILED DESCRIPTION

Figure 1:
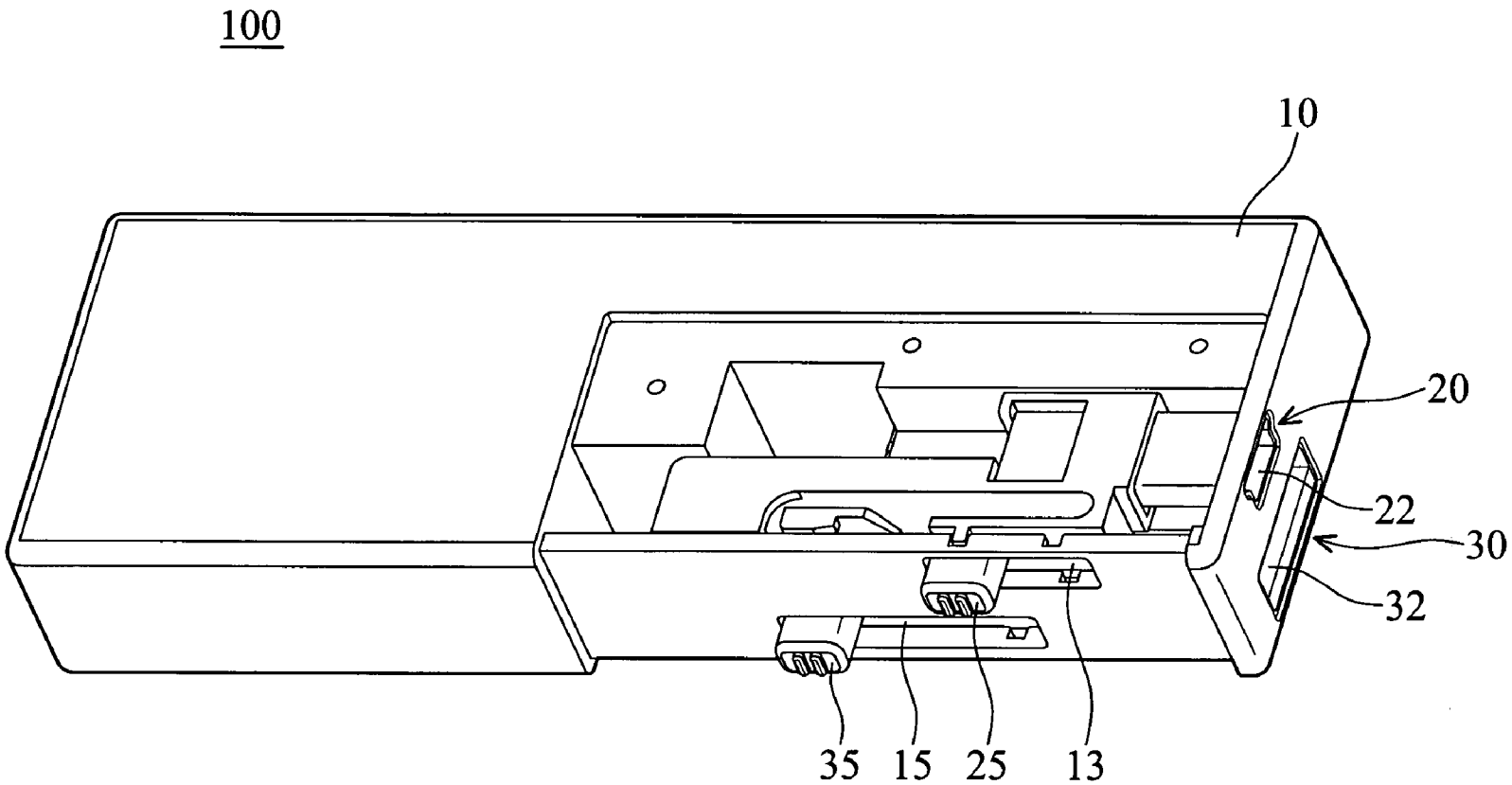
FIG. 1 is a perspective view of an embodiment of an electronic device with various signal transmission connectors according to the invention.

Referring to FIG. 1, a MP3 player 100 comprises a main body 10, a first USB module (first signal transmission module) 20 and a second USB module (second signal transmission module). The first USB module 20 is parallel to the second USB module 30. In this embodiment, the first USB module 20 is USB type B, and the second USB module 30 is USB type A.

Figure 2A:
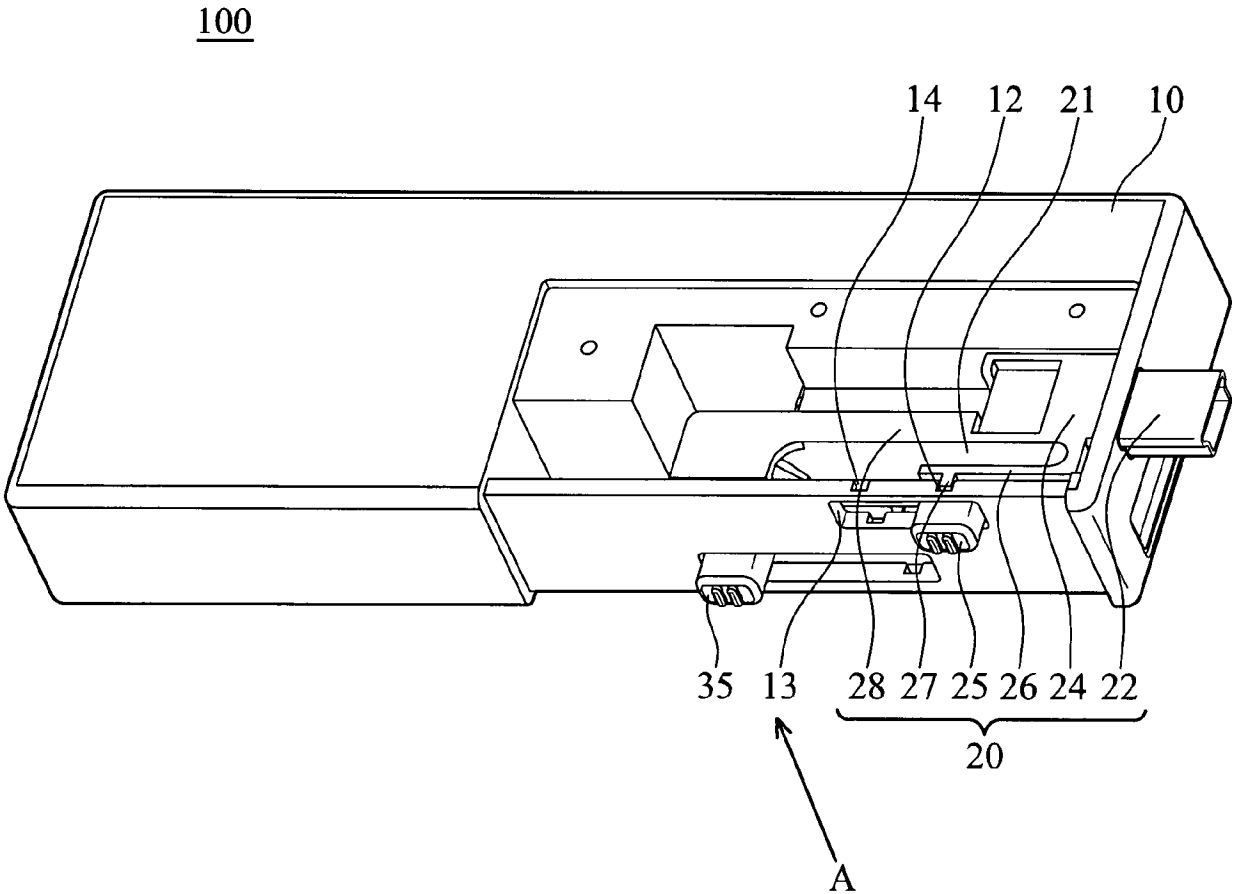
FIG. 2*a* is a perspective view of an embodiment of a first signal transmission module according to the invention.
Figure 2B:
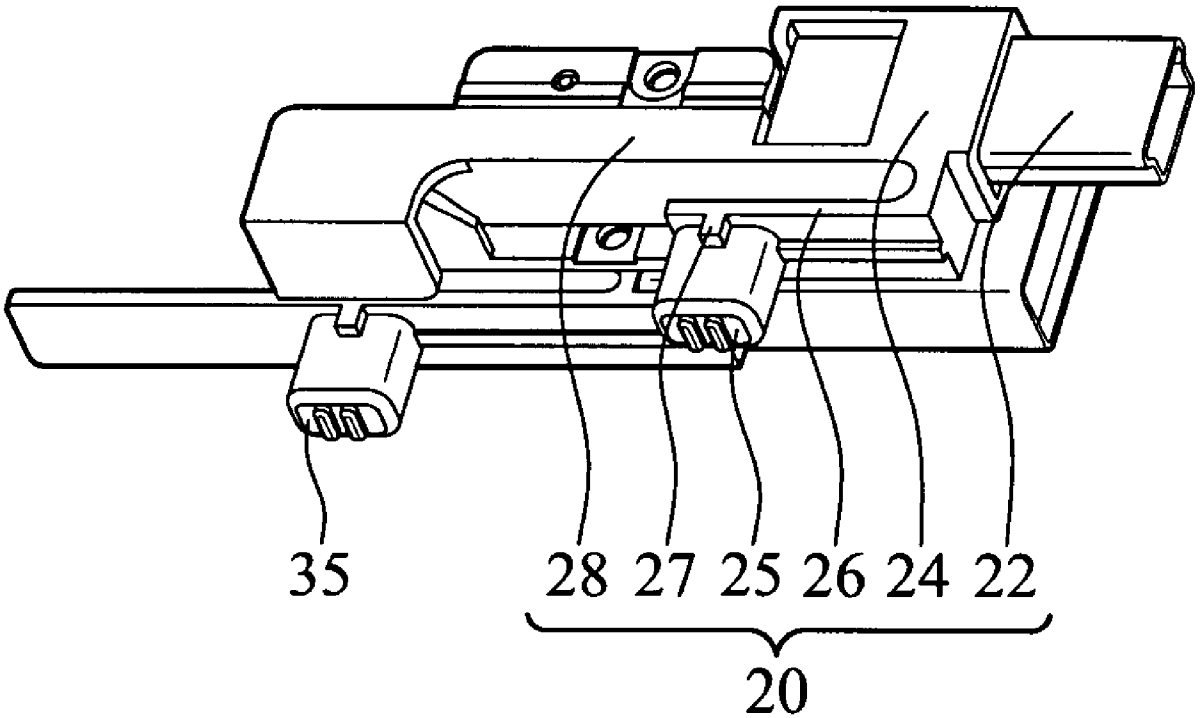
FIG. 2*b* is a perspective view of an embodiment of a first signal transmission module according to the invention, wherein the main body is removed.
Figure 2C:
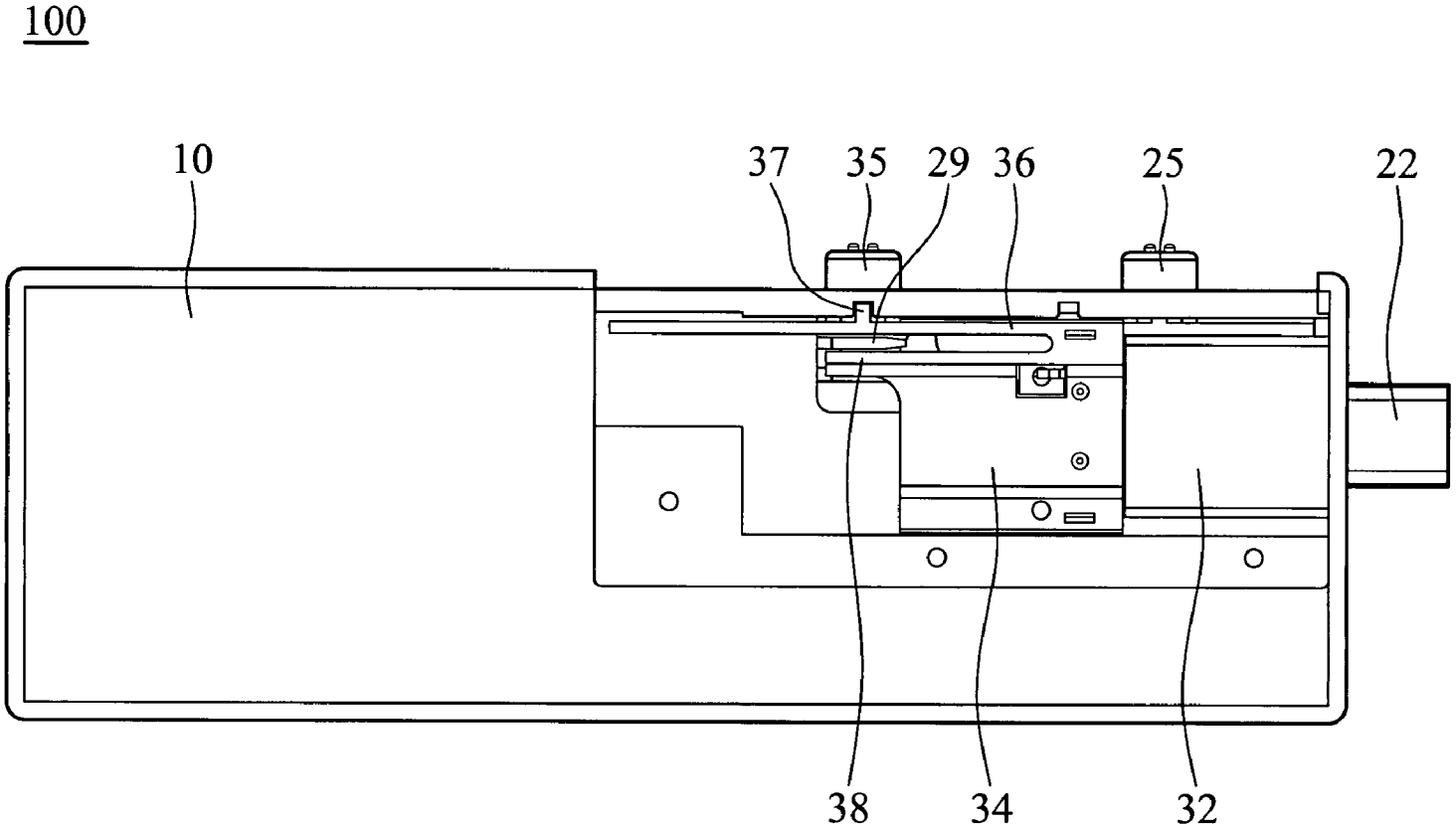
FIG. 2*c* is a plan view of FIG. 2*a* in the direction A.

Referring to FIGS. 2*a* to 2*c*, the first USB module 20 comprises a first connector 22, a module body 24, a first push portion 25, a first spring arm 26, a first positioning element 27 and a first extending portion 28. The first module body 24 is slidably disposed in the main body 10. The first connector 22 is connected to the first module body 24, whereby the first module body 24 slides to project the first connector 22 from the main body 10 for connection to other devices. The first spring arm 26 extends from the first module body 24, and the first extending portion 28 also extends from the first module body 24 parallel to the first spring arm 26 to form a first gap 21 between the first spring arm 26 and the first extending portion 28. A first push portion 25 is disposed on the first spring arm 26 and protrudes from the main body 10. The first positioning element 27 is also disposed on the first spring arm 26. The main body 10 comprises a first hole 12 and a second hole 14. When the first positioning element 27 engages the second hole 14, the first connector 22 is received in the main body 10. When the first push portion 25 is pressed, the first spring arm 26 deforms elastically to release the first positioning element 27 from the second hole 14. At the same time, the first push portion 25 is pushed to move along a groove 13 on the main body 10 to slide the first USB module 20 forward. When the first positioning element 27 engages the first hole 12, the first connector 22 projects from the main body 10.

Referring to FIGS. 3*a* to 3*d*, the second USB module 30 comprises a second connector 32, a module body 34, a second push portion 35, a second spring arm 36, a second positioning element 37 and a second extending portion 38. The second module body 34 is slidably disposed in the main body 10. The second connector 32 is connected to the second module body 34, whereby the second module body 34 slides to project the second connector 32 from the main body 10 for connection to other devices. The second spring arm 36 extends from the second module body 34, and the second extending portion 38 also extends from the second module body 34 parallel to the second spring arm 36 to form a second gap 31 between the second spring arm 36 and the second extending portion 38. A second push portion 35 is disposed on the second spring arm 36 and protrudes from the main body 10. The second positioning element 37 is also disposed on the second spring arm 36. The main body 10 comprises a third hole 16 and a fourth hole 18. When the second positioning element 37 engages the fourth hole 18, the second connector 32 is received in the main body 10. When the second push portion 35 is pressed, the second spring arm 36 deforms elastically to release the second positioning element 37 from the fourth hole 18. At the same time, the second push portion 35 is pushed to move along a groove 15(FIG. 1) on the main body 10 to slide the second USB module 30 forward. When the second positioning element 37 engages the third hole 16, the second connector 32 projects from the main body 10.

Because the first USB module 20 is USB type B for a MP3 player and the second USB module 30 is USB type A for a computer, when the first connector 22 is used, the second connector 32 is received in the main body 10. Similarly, when the second connector 32 is used, the first connector 22 is received in the main body 10. For the described purpose, the first USB module 20 further comprises a first stopper 29 extending from the first extending portion 28 toward the second USB module 30. Similarly, the second USB module 30 further comprises a second stopper 39 extending from the second extending portion 38 toward the first USB module 20.

Referring to FIG. 2*c*, when the first USB module 20 is pushed forward, the first stopper 29 engages the second gap 31(FIG. 3*d*), thus, the second push portion 35 cannot be pressed, and the second spring arm 36 cannot deform. Hence the second positioning element 37 remains engaged with the fourth hole 18 to secure the second USB module 30. The second connector 32, therefore, stays in the main body 10.

Figure 3A:
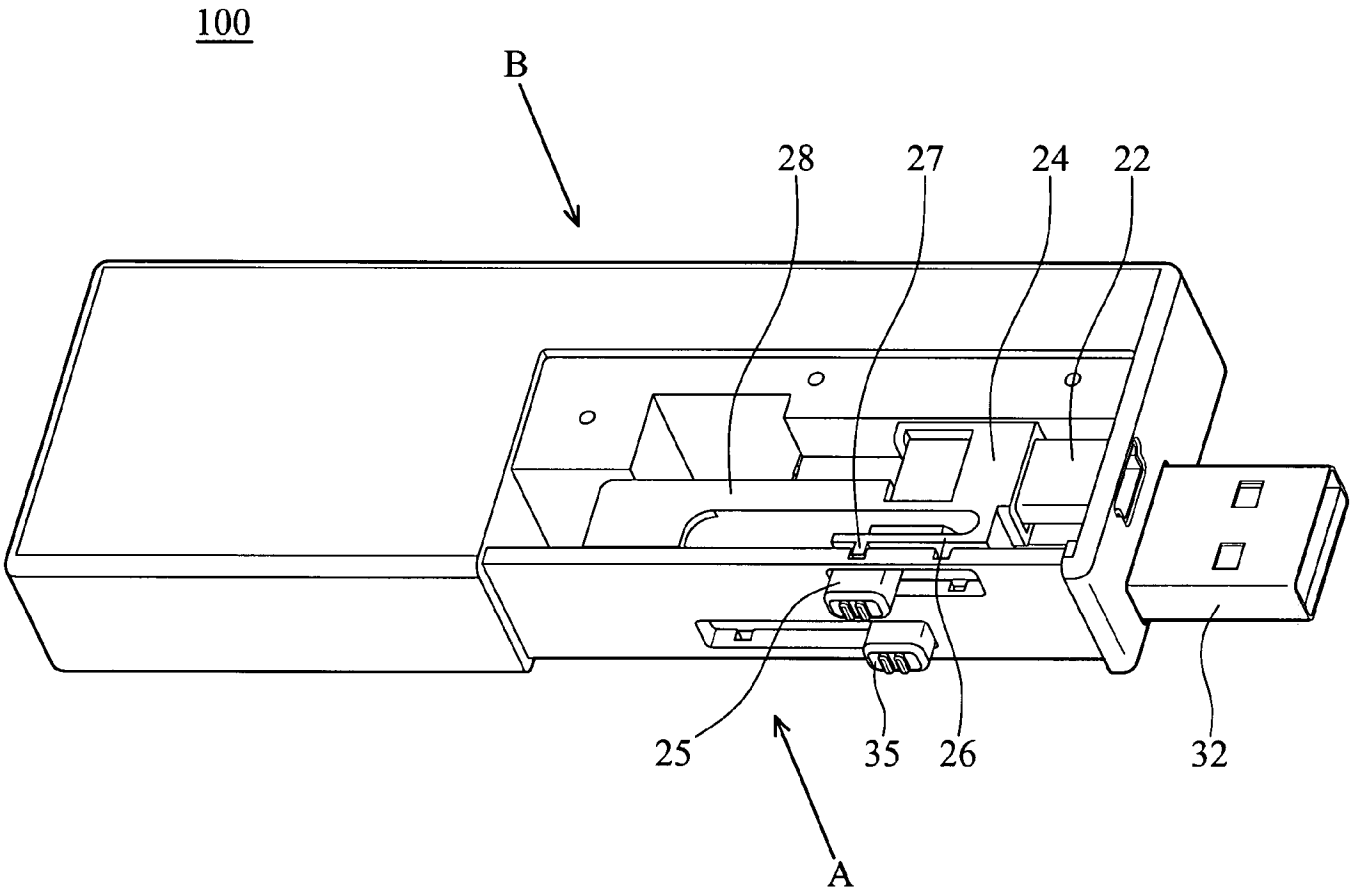
FIG. 3*a* is a perspective view of an embodiment of a second signal transmission module according to the invention.
Figure 3B:
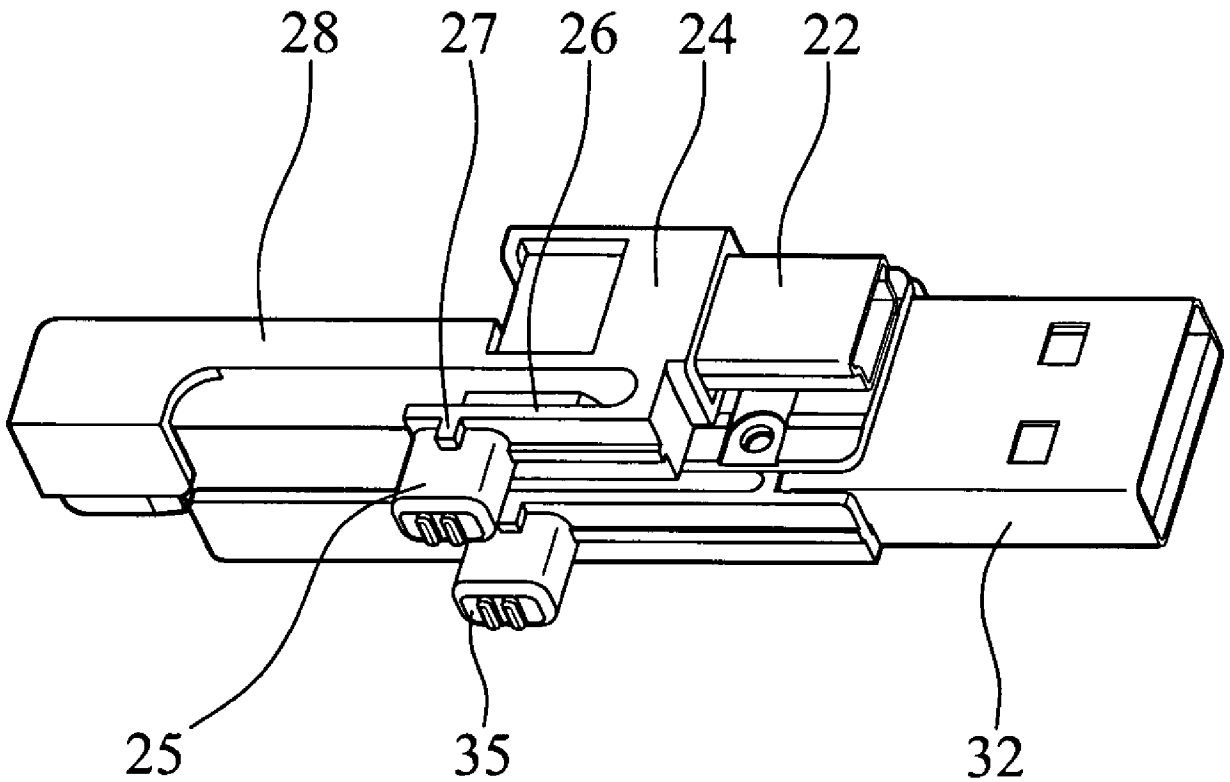
FIG. 3*b* is a perspective view of an embodiment of a second signal transmission module according to the invention, wherein the main body is removed.
Figure 3C:
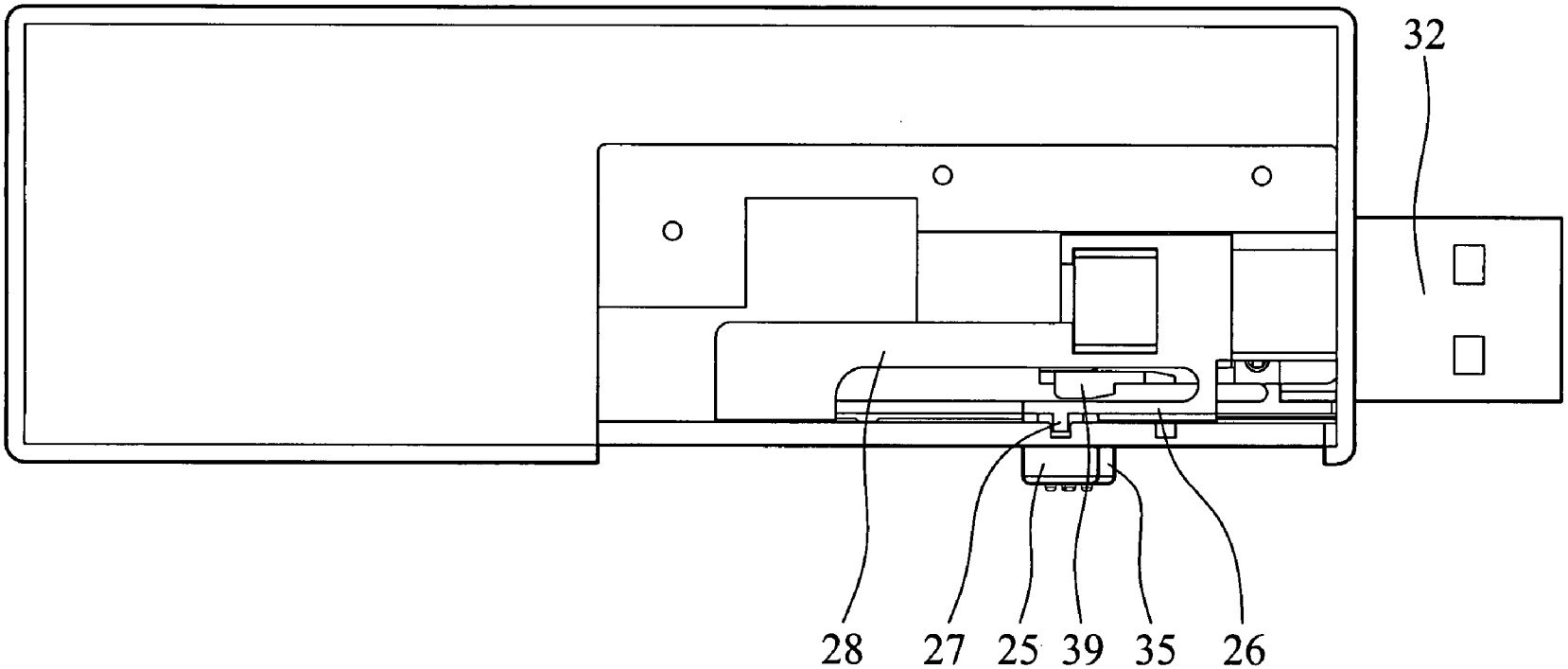
FIG. 3*c* is a plan view of FIG. 3*a* in the direction B.
Figure 3D:
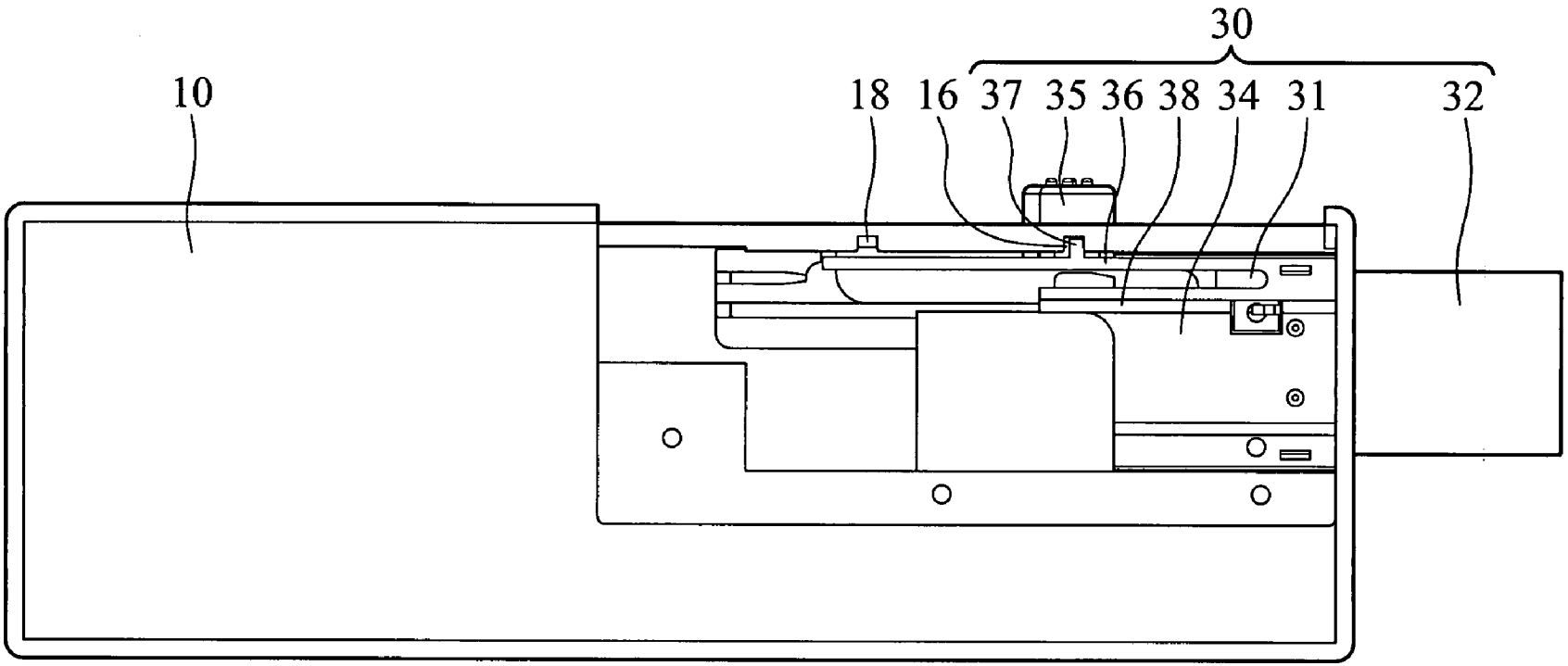
FIG. 3*d* is a plan view of FIG. 3*a* in the direction A.

Similarly, referring to FIG. 3*c*, when the second USB module 30 is pushed forward, the second stopper 39 engages the first gap 21, whereby the first push portion 25 cannot be pressed, and the first spring arm 26, cannot deform. Hence the first positioning element 27 remains engaged with the second hole 14 to secure the first USB module 20. The first connector 22, therefore, stays in the main body 10.

The MP3 player of the invention is provided with two USB modules of different types, which cannot be used simultaneously. Chips in the MP3 player determine whether the MP3 player is to be a host device or a slave device based on which connector is used.

Although a MP3 player is described, it is not limited thereto. The invention can also be applied to other electronic devices which have two signal transmission connectors.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An electronic device, comprising:

a main body;

a first signal transmission module slidably disposed in the main body and comprising a first connector projecting from or received in the main body; and a second signal transmission module slidably disposed in the main body and comprising a second connector projecting from or received in the main body, wherein the first connector and the second connector cannot project from the main body simultaneously but can be accommodated in the main body simultaneously.

2. The electronic device as claimed in claim 1, wherein the first signal transmission module is parallel to the second signal transmission module.

3. The electronic device as claimed in claim 1, wherein the first signal transmission module further comprises a first stopper engaging and fixing the second signal transmission module when the first signal transmission module slides to project the first connector from the main body, and the second signal transmission module further comprises a second stopper engaging and fixing the first signal transmission module when the second signal transmission module slides to project the second connector from the main body.

4. The electronic device as claimed in claim 3, wherein the first signal transmission module further comprises:

a first module body connected to the first connector and slidably disposed in the main body;

a first extending portion extending from the first module body;

a first spring arm extending from the first module body parallel to the first extending portion to form a first gap into which the second stopper is inserted to fix the first signal transmission module when the second connector projects from the main body.

5. The electronic device as claimed in claim 4, wherein the first stopper is disposed on the first extending portion.

6. The electronic device as claimed in claim 4, wherein the second signal transmission module further comprises:

a second module body connected to the second connector and slidably disposed in the main body;

a second extending portion extending from the second module body;

a second spring arm extending from the second module body parallel to the second extending portion to form a second gap into which the first stopper is inserted to fix the second signal transmission module when the first connector projects from the main body.

7. The electronic device as claimed in claim 4, wherein the first signal transmission module further comprises:

a first positioning element disposed on the first spring arm and securing the first module body to the main body when engaging with the main body;

a first push portion disposed on the first spring arm, wherein the first positioning element is released from the main body when the first push portion is pushed, whereby the first module body is slidable.

8. The electronic device as claimed in claim 7, wherein the main body comprises a first hole and a second hole, wherein the first connector projects from the main body when the first positioning element engages the first hole, and the first connector is received in the main body when the first positioning element engages the second hole.

9. The electronic device as claimed in claim 3, wherein the second signal transmission module further comprises:

a second module body connected to the second connector and slidably disposed in the main body;

a second extending portion extending from the second module body;

a second spring arm extending from the second module body and parallel to the second extending portion to form a second gap into which the first stopper is inserted to fix the second signal transmission module when the first connector projects from the main body.

10. The electronic device as claimed in claim 9, wherein the second stopper is disposed on the second extending portion.

11. The electronic device as claimed in claim 9, wherein the second stopper is disposed on the second extending portion.

12. The electronic device as claimed in claim 9, wherein the second signal transmission module further comprises:

a second positioning element disposed on the second spring arm and securing the second module body to the main body when engaging with the main body;

a second push portion disposed on the second spring arm, wherein the second positioning element is released from the main body when the second push portion is pushed, whereby the second module body is slidable.

13. The electronic device as claimed in claim 9, wherein the main body further comprises a third hole and a fourth hole, wherein the second connector projects from the main body when the second positioning element engages the third hole, and the second connector is received in the main body when the second positioning element engages the fourth hole.

14. The electronic device as claimed in claim 9, wherein the second signal transmission module further comprises:

a second positioning element disposed on the second spring arm and securing the second module body to the main body when engaging with the main body;

a second push portion disposed on the second spring arm, wherein the second positioning element is released from the main body when the second push portion is pushed, thereby enabling the second module body to slide.

15. The electronic device as claimed in claim 14, wherein the main body further comprises a third hole and a fourth hole, wherein the second connector projects from the main body when the second positioning element engages the third hole, and the second connector is received in the main body when the second positioning element engages the fourth hole.

* * * * *